US006018116A

United States Patent [19]

Simons et al.

[11] Patent Number: 6,018,116

[45] Date of Patent: Jan. 25, 2000

[54] CONGA SHELL PROTECTOR

[75] Inventors: Richard Simons, Garfield; Raymond Enhoffer, Clifton, both of N.J.

[73] Assignee: Latin Percussion Inc., Garfield, N.J.

[21] Appl. No.: 09/237,270

[22] Filed: Jan. 25, 1999

[51] Int. Cl.[7] ..... G10D 13/02

[52] U.S. Cl. ..... 84/411 R; 84/45.3; 248/345.1; 411/531

[58] Field of Search ..... 84/411 R, 413, 84/421, 453; 248/345.1; 411/155, 115, 531, 533, 536

[56] References Cited

U.S. PATENT DOCUMENTS

| | | | |
|---|---|---|---|
| D. 163,538 | 6/1951 | Orta | D56/1 |
| 1,980,876 | 11/1934 | Peters | 84/411 R |
| 2,561,937 | 7/1951 | McMullen | 84/421 |
| 3,125,190 | 3/1964 | Brennan | 189/29 |
| 3,433,115 | 3/1969 | Kjelstrom | 84/411 R |
| 3,611,863 | 10/1971 | Bayer et al. | 85/10 E |
| 4,122,747 | 10/1978 | Yamashita | 84/411 R |
| 4,295,770 | 10/1981 | Alderton | 411/531 |
| 4,709,613 | 12/1987 | Powers et al. | 84/413 |
| 4,731,918 | 3/1988 | Burghardt | 29/526 R |
| 4,898,061 | 2/1990 | Cohen et al. | 84/402 |
| 4,903,569 | 2/1990 | Kurosaki | 84/413 |
| 4,988,083 | 1/1991 | Bradley | 267/140 |
| 5,065,972 | 11/1991 | Buckshaw et al. | 248/345.1 |
| 5,149,575 | 9/1992 | Soifer | 428/188 |
| 5,417,136 | 5/1995 | Kralik et al. | 84/411 R |

FOREIGN PATENT DOCUMENTS

| | | |
|---|---|---|
| 1202205 | 3/1986 | Canada . |

OTHER PUBLICATIONS

Latin Percussion Catalog, "Professional Fiberglass Conga Drums," Jan. 1975.

*Primary Examiner*—Robert E. Nappi
*Assistant Examiner*—Wesley Scott Ashton
*Attorney, Agent, or Firm*—Ohlandt, Greeley, Ruggiero & Perle, LLP

[57] ABSTRACT

An arrangement for protecting adjacently situated musical drums in a group or assemblage comprising an external tuning mechanism affixed to the side of the shell of at least one drum, including a tuning rod extending and attached to the head of the drum for varying the tension on the head, wherein the rod is received in a receptacle and a nut is secured to the end of the rod for varying the applied tension; a protector device including an engaging with the receptacle and positioned to extend beyond the limit of the tuning mechanism's radial protrusion beyond the shell periphery, thereby to prevent or preclude contact with another drum shell except by the protector.

7 Claims, 2 Drawing Sheets

CONGA SHELL PROTECTOR

BACKGROUND OF THE INVENTION

The present invention relates to musical instruments and, more particularly, to protective devices useful in protecting drums and the like such as congas, djembe and other musical drums. It particularly relates to a simplified improvement in the construction of a protective device for overcoming difficulties presented in the playing of such drums.

The normal arrangement for playing these instruments is in multiple sizes which are either on a stand or placed on the floor. The most common position for playing has the drums as close as possible for playing comfort. It will be understood that the playing of musical drums, such as conga drums and the like, involves a fair degree of frenetic rhythmic movements, with the consequence that the instrument sometimes bang together. Since the shells of these drums are commonly made of wood, fiberglass or composite materials with the exteriors usually finished in a fine wood finish, gel coat or other decorative finish, they are sensitive to coming into contact with each other. It will be understood that the tuning mechanisms involved with such drums are commonly made from steel including a threaded rod and nut which are adjusted to vary the tension on the drum head.

In a particular case of the above-noted musical drums, external tuning devices have been provided and these protrude from the side of the drum shell. Due to the large external forces required to tune by stretching the head (made of skin or a synthetic material), the tuning mechanisms tend to be large and obtrusive. It is very common as explained that the drums come together and make contact while being played, as well as when they are being handled, that the tuning mechanisms which are commonly made from steel as above described will hit the side of the drum shell causing the finish to become damaged, either by chipping the wood such that this type of damage ruins the appearance and value of the instruments.

Previous attempts at solving this problem have included sheathing the entire areas. However, in addition to being cumbersome it is found to be detrimental when one is trying to tune or tension the drum head.

SUMMARY OF THE INVENTION

Accordingly it is a primary object of the present invention to provide a solution that enables avoiding or preventing the striking of the side of the drum shell by the tuning mechanisms, thereby damaging it.

A further object is to accomplish the above by a very simple means which is attached to the tuning mechanism.

A protector device according to the present invention prevents the shells of adjacent conga drums from directly contacting one another. At least one of the drums has a tuning rod that is connected to the drum head and extends through a receptacle that is connected to the drum shell. The protective device is in the form of a washer that receives the tuning rod and engages the receptacle. A resilient material covers the washer and extends outwardly therefrom to protect the drum shell from contact with the shells of the adjacent drums.

Other and further objects, advantages and features of the present invention will be understood by reference to the following specification in conjunction with the annexed drawings, wherein like parts have been given like numbers.

DESCRIPTION OF THE INVENTION

Figure 1:
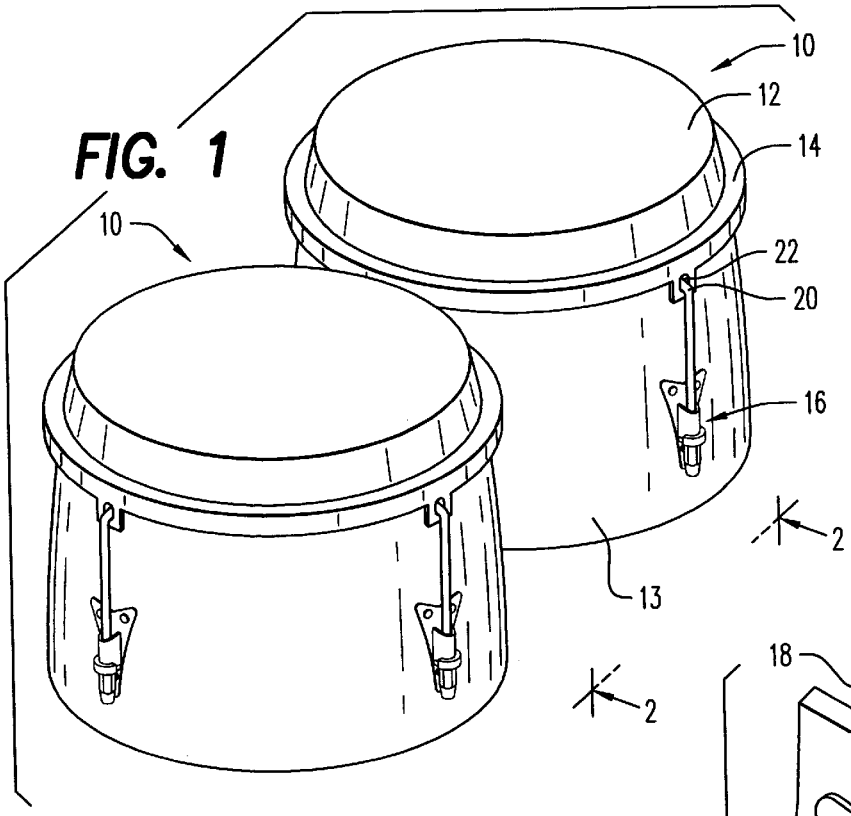
FIG. 1 is a perspective view of a group or assemblage of conga drums closely spaced with respect to each other.

Referring now to the Figures of the drawing and particularly for the moment to FIG. 1, there will be seen a group or assemblage of two conga drums 10 which can be part of an even larger group of three or more. The drums 10 as illustrated for explaining the present invention can, of course, be positioned in a variety of different locations and can be suitably mounted. However, for purposes of the invention it will be assumed that they are very closely spaced from each other, this giving rise to the problem already explained.

Each of the drums 10 is constructed to have a drum head 12 composed of skin, or alternately, of synthetic material. The skin is maintained in a conventional manner within a ring 14. The skin is gripped, whereby tension can be applied for tuning purposes, the tuning being accomplished by reason of tuning mechanisms 16 spaced around the periphery of each of the drums, usually four or five in number.

Each of the tuning mechanisms 16, which serve to vary the skin tension completely around the ring 14, includes a rod 18 which is provided, at its upper end, with a hook 20 fitting into an opening 22 in a boss formed integrally with the ring 14. The rod 18, forming part of the mechanism 16, is received in a receptacle 30 and extends through the receptacle so as to be engaged with conventional elements: a washer 32 and a nut 34. The nut 34 is selectively moved along the threads 36 of the rod 18 to adjust the tuning of a given drum by applying greater or lesser tension to the head 12 of the drum through the action of ring 14. It will be clear that the receptacle 30 is an integral part of a plate 37 which functions to enable attachment of the tuning mechanism 16 by suitable rivets or the like to the shell 13 of the drum.

Uniquely designed in accordance with the present invention is the protector device 40 for protecting adjacent musical drums in the aforedescribed group or assemblage of such drums. Instead of sheathing the entire area surrounding the tuning mechanism 16, a simple specially constructed drawn washer has been devised and its relationship to other elements established, such that by that by this simple means the drum shell 13 does not sustain damage when, in the context of a frenetic, rhythmic playing of the drums, they inadvertently bump or bang into each other.

Figure 2:
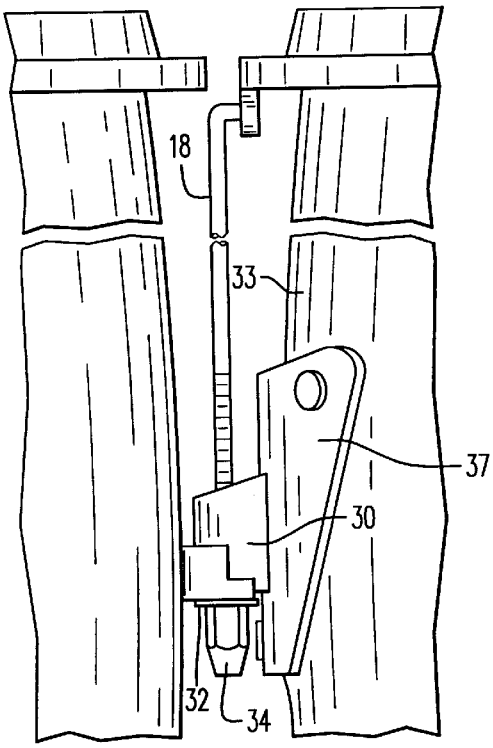
FIG. 2 is an elevation view showing two conga drums in closely spaced relationship and showing the effect in one situation involving tuning means at spaced locations on each of the drums, and particularly depicting the effect of the protector means or device.
Figure 3:
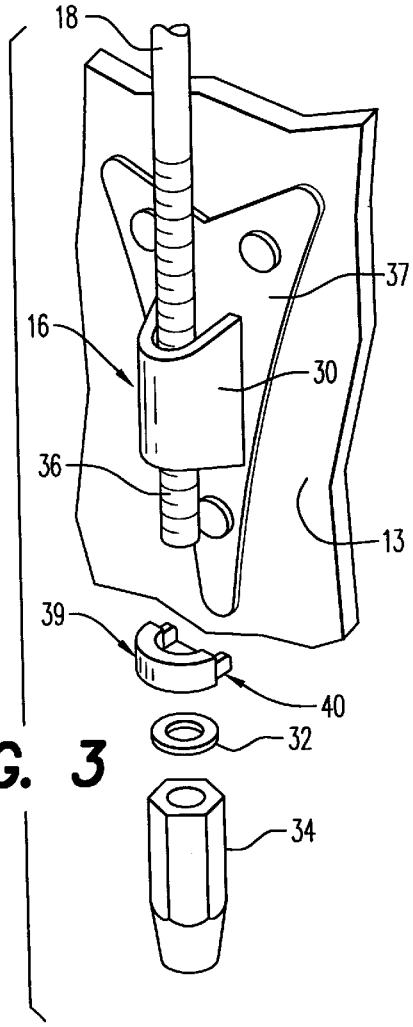
FIG. 3 is an exploded view of the protector device and its relationship to the other elements of the tuning mechanism.
Figure 4:
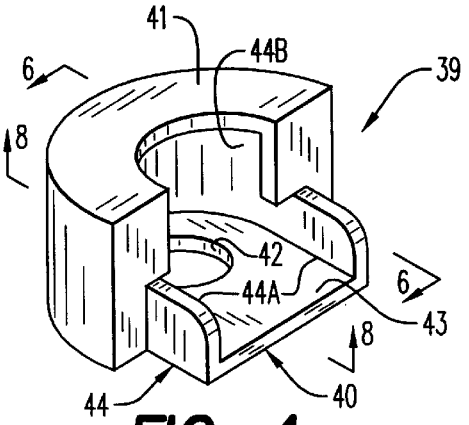
FIG. 4 is a perspective view of the protector device, particularly illustrating a bottom plate portion having a rod-receiving opening and with resilient material affixed to the upstanding sides, particularly to the curved portion of the sides.
Figure 5:
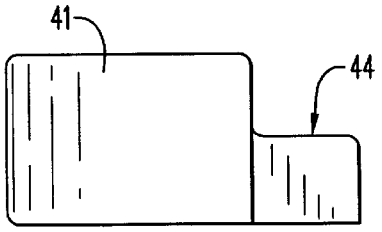
FIG. 5 is a side elevation view of the protector device.
Figure 6:
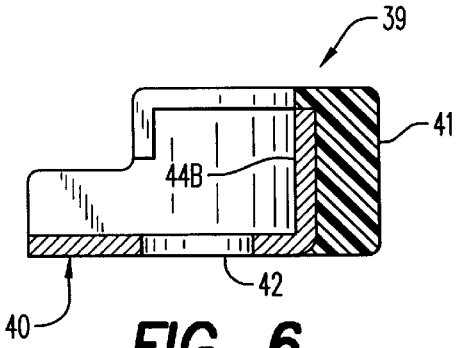
FIG. 6 is a cross-sectional view taken on the line 6—6 of FIG. 4.
Figure 7:
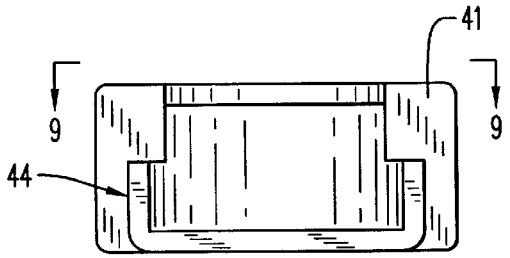
FIG. 7 is a front view.
Figure 8:
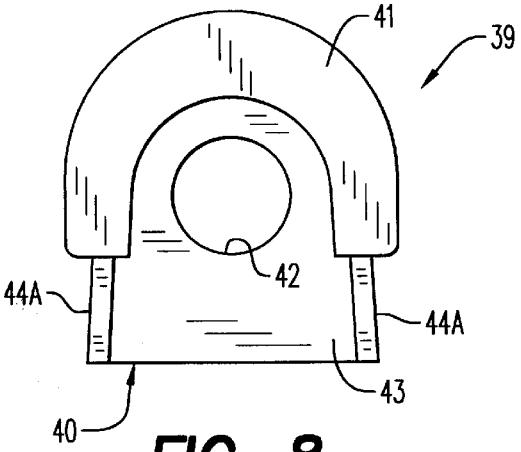
FIG. 8 is a top plan view of the device.
Figure 9:
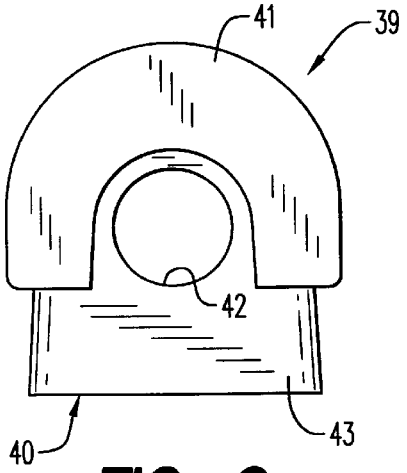
FIG. 9 is a bottom plan view of the device.

Thus, as will be seen in FIGS. 2 and 3, the protector device 39 is in the form of a special, drawn washer 40—basically of metal for strength but including a resilient covering 41—is preferably placed in association with the other elements already described by having the washer 40 surround the tuning rod 18 at its lower end and abut the conventional washer 32. The special washer 40 has an opening 42 and is so sized that when in the position seen in FIG. 2, it will protrude radially beyond the radial projection of the other elements of the tuning mechanism, that is, the receptacle 30, washer 32, and nut 34, thereby to prevent, due to the resilient covering 41, damaging contact with another adjacent drum shell except by the contact of the protector device against the shell.

As seen in detail in FIGS. 4–9, a specific embodiment of the protector devices includes, or is defined by a bottom plate-like member 43 having upstanding side 44. The front portions 44A of the side are upstanding but to a somewhat limited extent, whereas the annular portion 44B projects to a greater extent. Annular portion 44B has a curvature that is substantially the same as the curvature of the exterior surface of receptacle 30. Annular portion 44B is covered by resilient covering 41 that furnishes the resilience needed for the purpose explained, that is to absorb the forces involved when the drums 10 make contact. Resilient covering 41 may be formed by molding rubber around and above the annular portion 44B of the metal washer. The rubber can be plastic, silicone or like materials.

The invention having been thus described with particular reference to the preferred forms thereof, it will be obvious that various changes and modifications may be made therein without departing from the spirit and scope of the invention as defined in the appended claims.

What is claimed is:

1. A protector device for protecting a plurality of adjacently situated musical drums in a group or assemblage, at least one of said plurality of musical drums having a head and a shell with an external tuning mechanism affixed to said shell, said tuning mechanism including a receptacle and a tuning rod having a first end and a second end, said first end being attached to the head of said one drum for varying the tension on the head, wherein said tuning rod is received in the receptacle, and wherein a nut is secured to said second end of said tuning rod for varying the applied tension to the head of said one drum, the protector device comprising:

a washer positioned to engage said receptacle, said washer being formed to have (a) a bottom plate with an opening therein to accommodate said tuning rod, (b) an upstanding side extending from said bottom plate, said upstanding side having an annular portion, and (c) a resilient material covering said annular portion, said resilient material extending outwardly from said annular portion by a distance that precludes contact between said shell and a shell of another of said plurality of drums.

2. The protector device as defined in claim 1, wherein said upstanding side has two straight portions connected to said annular portion, with all of said portions being at said edge of the bottom plate.

3. The protector device as defined in claim 2, wherein said receptacle has an exterior surface with a curvature, and wherein said annular portion has a curvature that is substantially the same as the curvature of the exterior surface of the receptacle.

4. Apparatus for protecting a plurality of adjacently situated musical drums in a group or assemblage, at least one of said plurality of musical drums having a head and a shell with an external tuning mechanism affixed to said shell, said tuning mechanism including a receptacle and a tuning rod having a first end and a second end, said first end being attached to the head of said one drum for varying the tension on the head, wherein said tuning rod is received in the receptacle, and wherein a nut is secured to said second end of said tuning rod for varying the applied tension to the head of said one drum, the apparatus comprising:

a protector device engaging with the receptacle and having a washer to accommodate the tuning rod and a resilient cover that extends outwardly from said shell by a distance that precludes contact between said shell and a shell of another of said plurality of drums.

5. A protector device for protecting a plurality of adjacently positioned musical drums, at least one of said drums including a shell with a receptacle and at least one tuning rod received in said receptacle said protector device being formed to surround said tuning rod and engage the receptacle, the protector device being in the form of a washer having a bottom plate with an opening therein to accommodate said tuning rod, and having an upstanding side from said bottom plate, said upstanding side having an annular portion and a resilient material covering said annular portion to prevent the shell of said one drum from contacting another of said plurality of drums.

6. The protector device as defined in claim 5, wherein the upstanding side has two straight portions connected to said annular portion, with all of said portions being at the edge of the bottom plate.

7. The protector device as defined in claim 5, wherein the receptacle has an exterior surface with a curvature and wherein said annular portion has a curvature that is substantially the same as the curvature of the exterior surface of the receptacle.

* * * * *